US010180282B2

(12) United States Patent
Wehrman et al.

(10) Patent No.: US 10,180,282 B2
(45) Date of Patent: Jan. 15, 2019

(54) PARALLEL COMPRESSION IN LNG PLANTS USING A POSITIVE DISPLACEMENT COMPRESSOR

(71) Applicant: AIR PRODUCTS AND CHEMICALS, INC., Allentown, PA (US)

(72) Inventors: Joseph Gerard Wehrman, Macungie, PA (US); Gowri Krishnamurthy, Sellersville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 223 days.

(21) Appl. No.: 14/870,557

(22) Filed: Sep. 30, 2015

(65) Prior Publication Data

US 2017/0089637 A1 Mar. 30, 2017

(51) Int. Cl.

| | |
|---|---|
| ***F25J 1/00*** | (2006.01) |
| ***F25J 1/02*** | (2006.01) |
| ***F04B 25/00*** | (2006.01) |
| ***F04B 41/06*** | (2006.01) |
| ***F04C 18/16*** | (2006.01) |
| ***F04C 23/00*** | (2006.01) |
| ***F04D 17/10*** | (2006.01) |
| ***F04D 25/16*** | (2006.01) |

(52) U.S. Cl.

CPC ..... *F25J 1/0294* (2013.01); *F04B 25/00* (2013.01); *F04B 41/06* (2013.01); *F04C 18/16* (2013.01); *F04C 23/005* (2013.01); *F04D 17/10* (2013.01); *F04D 25/16* (2013.01); *F25J 1/0022* (2013.01); *F25J 1/0052* (2013.01); *F25J 1/0055* (2013.01); *F25J 1/0087* (2013.01); *F25J 1/0216* (2013.01); *F25J 1/0292* (2013.01); *F25J 1/0296* (2013.01); *F25B 2400/0751* (2013.01)

(58) Field of Classification Search

CPC ..... F25J 1/0022; F25J 1/0216; F25J 1/0294; F25J 1/0052; F25J 1/0047; F25J 1/029; F25J 1/0292; F25J 1/0296; F25J 1/0087

See application file for complete search history.

(56) References Cited

U.S. PATENT DOCUMENTS

| | | |
|---|---|---|
| 6,116,027 A | 9/2000 | Smith et al. |
| 8,650,906 B2 | 2/2014 | Price et al. |

(Continued)

FOREIGN PATENT DOCUMENTS

| | | |
|---|---|---|
| EP | 2444759 | 4/2012 |
| JP | S61-003985 | 1/1986 |

(Continued)

OTHER PUBLICATIONS

Krishnamurthy, Gowri, et al., Drive Your LNG Project to Success With Optimal Machinery Selections from Air Products of U.S., LNG Journal, May 2015, pp. 36-39.

*Primary Examiner* — Keith Raymond
(74) *Attorney, Agent, or Firm* — Amy Carr-Trexler

(57) ABSTRACT

A system and method for increasing the capacity and efficiency of natural gas liquefaction processes by debottlenecking the refrigerant compression system. A secondary compression circuit comprising at least one positive displacement compressor is provided in parallel fluid flow communication with at least a portion of a primary compression circuit comprising at least one dynamic compressor.

28 Claims, 7 Drawing Sheets

(56) References Cited

U.S. PATENT DOCUMENTS

| | | | | |
|---|---|---|---|---|
| 2002/0170312 | A1* | 11/2002 | Reijnen | F25J 1/0022 62/611 |
| 2012/0067080 | A1* | 3/2012 | Byfield | F25B 1/10 62/613 |
| 2013/0058800 | A1* | 3/2013 | Sites | F04D 25/04 417/53 |
| 2013/0177393 | A1* | 7/2013 | Sishtla | F25B 1/10 415/1 |
| 2013/0340475 | A1* | 12/2013 | Turner | F25J 1/0022 62/613 |

FOREIGN PATENT DOCUMENTS

| | | | |
|---|---|---|---|
| JP | 2000120583 | | 4/2000 |
| JP | 2000283571 | | 10/2000 |
| JP | 2003515720 | | 5/2003 |
| JP | 2005023818 | | 1/2005 |
| JP | 2008504509 | | 2/2008 |
| JP | 2011506893 | | 3/2011 |
| WO | 03098128 | A1 | 11/2003 |
| WO | 2009117787 | | 10/2009 |
| WO | 2011146231 | | 11/2011 |
| WO | 2014048845 | A1 | 4/2014 |

* cited by examiner

PARALLEL COMPRESSION IN LNG PLANTS USING A POSITIVE DISPLACEMENT COMPRESSOR

BACKGROUND

A number of liquefaction systems for cooling, liquefying, and optionally sub-cooling natural gas are well known in the art, such as the single mixed refrigerant (SMR) cycle, the propane pre-cooled mixed refrigerant (C3MR) cycle, the dual mixed refrigerant (DMR) cycle, C3MR-Nitrogen hybrid (such as AP-X™) cycles, the nitrogen or methane expander cycle, and cascade cycles. Typically, in such systems, natural gas is cooled, liquefied, and optionally sub-cooled by indirect heat exchange with one or more refrigerants. A variety of refrigerants might be employed, such as mixed refrigerants, pure components, two-phase refrigerants, gas phase refrigerants, etc. Mixed refrigerants (MR), which are a mixture of nitrogen, methane, ethane/ethylene, propane, butanes, and pentanes, have been used in many base-load liquefied natural gas (LNG) plants. The composition of the MR stream is typically optimized based on the feed gas composition and operating conditions.

The refrigerant is circulated in a refrigerant circuit that includes one or more heat exchangers and one or more refrigerant compression systems. The refrigerant circuit may be closed-loop or open-loop. Natural gas is cooled, liquefied, and/or sub-cooled by indirect heat exchange against the refrigerants in the heat exchangers.

Each refrigerant compression system includes a compression circuit for compressing and cooling the circulating refrigerant, and a driver assembly to provide the power needed to drive the compressors. The refrigerant compression system is a critical component of the liquefaction system because the refrigerant needs to be compressed to high pressure and cooled prior to expansion in order to produce a cold low pressure refrigerant stream that provides the heat duty necessary to cool, liquefy, and optionally sub-cool the natural gas.

A majority of the refrigerant compression in base-load LNG plants is performed by dynamic or kinetic compressors, and specifically centrifugal compressors, due to their inherent capabilities including high capacity, variable speed, high efficiency, low maintenance, small size, etc. Other types of dynamic compressors such as axial compressors and mixed flow compressors have also been used for similar reasons. Dynamic compressors function by increasing the momentum of the fluid being compressed. In contrast, positive displacement compressors function by reducing the volume of the fluid being compressed. Positive displacement compressors such as reciprocating and screw compressors have typically not been preferred in base-load LNG service because of their lower flow capability that in turn leads to the need for many units, higher cost, and larger plot area.

There are four main types of drivers that have been used in LNG service, namely industrial gas turbines, aero-derivative gas turbines, steam turbines, and electric motors.

In some scenarios, the LNG production rate may be limited by the installed refrigerant compressor. One such scenario is when the compressor operating point is close to the anti-surge line. Surge is defined as an operating point at which the maximum head capability and minimum volumetric flow limit of the compressor are reached. The anti-surge line is an operating point at a safe operating approach to surge. An example of such a scenario for a C3MR cycle is at high ambient temperature where there is an increased load on the propane pre-cooling system causing the maximum head and thereby lowest allowable flow rate to be reached. Therefore, the refrigerant flow rate is limited, which then limits the refrigeration and LNG production rate.

Another scenario where the LNG production rate is limited by the installed refrigerant compressor is when the compressor is close to stonewall or choke. Stonewall or choke is defined as the operating point where the maximum stable volumetric flow and minimum head capability of the compressor are reached. An example of such a scenario is when the plant is fully loaded and is running at maximum LNG capacity. The compressor cannot take any more refrigerant flow through it and the plant is therefore limited by the compressor operation.

A further scenario where the LNG production may be limited by the installed refrigerant compressor is for large base-load facilities where the compressor operating points are limited by compressor design specifications, such as the flow coefficient, the inlet Mach number, etc.

In some scenarios, the LNG production is limited by the available driver power. This can happen when the plant is operating at high LNG production rates. It can also happen for plants with gas turbine drivers at high ambient temperature due to reduced available gas turbine power.

One approach to debottleneck the refrigerant compression system is to add an additional dynamic compressor, such as a centrifugal compressor, with its driver at the discharge of the primary compressor. This helps build more head into the compression system for a scenario where the compressor is operating close to the anti-surge line, but adding an additional dynamic compressor at the discharge of the primary compressor has limited benefits when the compressor is operating close to stonewall. Therefore, the addition of the additional dynamic compressor will not solve the problem of maximum flow constraint.

Another approach has been to add a secondary dynamic compressor such as a centrifugal compressor in parallel with the primary compressor. The secondary compressor is typically much smaller in capacity as compared to the primary compressor and this poses a challenge with respect to balancing the two parallel compressors and ensuring that the outlet pressure match up although the volumetric flow rates may not. The head versus capacity curve of a typical dynamic compressor is shown in FIG. 1. Given the gradual shape of the curve, matching the head at the outlet yet making sure that the total flow adds up the desired refrigerant flow can be challenging. The addition of a similar size second compressor to debottleneck the system is not a likely option due to the large costs associated with matching the compressor size.

Furthermore, it is difficult to adjust the flow split between two parallel dynamic compressors with different flow characteristics (as described above) as operational conditions in the compression system change. For example, in a C3MR plant operating close to the anti-surge line, as the ambient temperature reduces, the approach to surge increases and a lower flow rate through the secondary compressor is required. Additionally, the parameters of the secondary compressor, such as speed, typically cannot be varied because such variation will result in a change in the outlet pressure, creating an imbalance with the primary compressor. Further, in scenarios wherein the primary compressor is a mixed refrigerant compressor, any variations in MR composition with changing feed composition and ambient conditions might lead to an imbalance of the two compressors. Many of these challenges are driven by the fact that both compressors are not identical and the second compressor is typically of much smaller capacity than the main compressor.

Overall, adding a lower capacity dynamic compressor in parallel with the primary compressor leads to an inflexible design that could be challenging to design and operate efficiently. Therefore, what is needed is a simpler and more efficient method of debottlenecking loaded compression systems in an LNG plant.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments provide, as described below and as defined by the claims which follow, comprise improvements to compression systems used as part of an LNG liquefaction processes. The disclosed embodiments satisfy the need in the art by using a positive displacement compressor in parallel with at least one dynamic compressor in one or more of the refrigerant compression systems of an LNG liquefaction plant, thereby enabling the plant to operate under conditions that would otherwise limit plant capacity.

In addition, several specific aspects of the systems and methods of the present invention are outlined below.

Aspect 1—An apparatus for liquefying a hydrocarbon fluid comprising:

a compression system operationally configured to compress a first refrigerant to produce a first compressed refrigerant stream, the compression system comprising a primary compression circuit having at least one compression stage comprising a dynamic compressor and a secondary compression circuit having at least one compression stage comprising a positive displacement compressor, the secondary compression circuit being in fluid flow communication with the primary compression circuit and arranged parallel to at least a first portion of the primary compression circuit, the compression system further comprising a driver assembly operationally configured to provide power to the at least one compression stage of the primary compression circuit and the at least one compression stage of the secondary compression circuit;

a first heat exchanger operationally configured to cool the hydrocarbon fluid by indirect heat exchange between at least a portion of the first refrigerant and the hydrocarbon fluid.

Aspect 2—The apparatus of Aspect 1, wherein the at least one compression stage of the primary compression circuit comprises a plurality of compression stages, each of the plurality of compression stages being a dynamic compressor, and each of the at least one compression stage of the secondary compression circuit is a positive displacement compressor.

Aspect 3—The apparatus of Aspect 2, wherein the compression system is further operationally configured to intercool the first refrigerant between at least two of the plurality of compression stages of the primary compression circuit.

Aspect 4—The apparatus of any of Aspects 1-3, wherein the primary compression circuit comprises a plurality of compression stages and the primary compression circuit comprises a second portion, at least one of the plurality of compression stages being located in the first portion and at least one of the plurality of compression stages being located in the second portion, the secondary compression circuit being arranged in parallel with only the first portion of the primary compression circuit, each of the at least one of the plurality of compression stages located in the first portion being operationally configured to operate at a higher pressure than all of the at least one of the plurality of compression stages located in the second portion.

Aspect 5—The apparatus of any of Aspects 1-4, further comprising a second heat exchanger operationally configured to further cool and liquefy the hydrocarbon fluid by indirect heat exchange between the hydrocarbon fluid and a second refrigerant after the hydrocarbon fluid has been cooled by the first heat exchanger.

Aspect 6—The apparatus of any of Aspects 1-5, wherein the first refrigerant is propane, a mixed refrigerant, or nitrogen.

Aspect 7—The apparatus of any of Aspects 5-6, wherein the second heat exchanger is operationally configured to liquefy the hydrocarbon fluid and cool the second refrigerant as the hydrocarbon fluid and the second refrigerant flow through a coil wound tube side of the second heat exchanger by indirect heat exchange with the second refrigerant flowing through a shell side of the second heat exchanger.

Aspect 8—The apparatus of Aspect 1, further comprising a second heat exchanger operationally configured to precool the hydrocarbon fluid by indirect heat exchange between the hydrocarbon fluid and a second refrigerant before the hydrocarbon fluid is further cooled by the first heat exchanger.

Aspect 9—The apparatus of any of Aspects 1 and 8, wherein the second refrigerant is propane and the first refrigerant is a mixed refrigerant.

Aspect 10—The apparatus of any of Aspects 1 and 8-9, wherein the first heat exchanger is operationally configured to liquefy the hydrocarbon fluid and cool the first refrigerant as the hydrocarbon fluid and the first refrigerant flow through a coil wound tube side of the first heat exchanger by indirect heat exchange with the first refrigerant flowing through a shell side of the first heat exchanger.

Aspect 11—The apparatus of any of Aspects 1-10, wherein the driver assembly including a first driver for the primary compression circuit and a second driver for the secondary compression circuit, the first driver being independent of the second driver.

Aspect 12—The apparatus of any of Aspects 1-11, further comprising a valve operationally configured to control a distribution of flow of the first refrigerant between primary compression circuit and the secondary compression circuit.

Aspect 13—The apparatus of any of Aspects 1-12, wherein the dynamic compressor is a centrifugal compressor and the positive displacement compressor is a screw compressor.

Aspect 14—A method comprising:

a. performing a compression sequence on a first refrigerant stream, the compression sequence comprising compressing the first refrigerant stream to produce a compressed first refrigerant stream; and b. cooling a hydrocarbon fluid by indirect heat exchange against the compressed first refrigerant stream to produce a first hydrocarbon fluid output stream and a warmed first refrigerant stream;

wherein step (a) further comprises splitting the first refrigerant stream into a first portion and a second portion, compressing the first portion of the first refrigerant stream in a primary compression sequence including at least one dynamic compressor to produce a primary compressed stream, compressing the second portion of the first refrigerant stream in a secondary compression sequence including at least one positive displacement compressor to produce a secondary compressed stream, and combining the primary compressed stream and the secondary compressed stream to produce a combined compressed refrigerant stream.

Aspect 15—The method of Aspect 14, wherein step (a) further comprises compressing the first portion of the first refrigerant stream in a plurality of compression stages in the primary compression sequence.

Aspect 16—The method of any of Aspects 14-15, wherein step (a) further comprises compressing the first refrigerant stream in at least one of the plurality of compression stages of the primary compression sequence before splitting the first refrigerant stream into the first portion and the second portion.

Aspect 17—The method of any of Aspects 14-16, wherein step (a) further comprises cooling the first refrigerant stream between two of the plurality of compression stages.

Aspect 18—The method of any of Aspects 14-17, wherein step (a) further comprises removing a third portion of the first refrigerant from the first refrigerant stream before splitting the first refrigerant stream into the first portion and the second portion.

Aspect 19—The method of any of Aspects 14-18, wherein step (a) further comprises combining at least one first refrigerant side stream with the first refrigerant stream.

Aspect 20—The method of any of Aspects 14-19, wherein step (a) further comprises combining at least one of the at least one first refrigerant side stream with the first refrigerant stream before splitting the first refrigerant stream into the first portion and the second portion.

Aspect 21—The method of any of Aspects 14-20, wherein step (a) further comprises cooling the combined compressed refrigerant stream in at least one heat exchanger prior to producing the compressed first refrigerant stream.

Aspect 22—The method of any of Aspects 14-20, wherein step (a) further comprises further compressing the combined compressed refrigerant stream prior to producing the compressed first refrigerant stream.

Aspect 23—The method of any of Aspects 14-22, wherein the compressed first refrigerant stream is cooled and expanded prior to the indirect heat exchange in step (b).

Aspect 24—The method of any of Aspects 14-23, wherein step (a) further comprises splitting the first refrigerant stream into the first portion and the second portion, the first portion comprising at least 70% of the first refrigerant stream.

Aspect 25—The method of any of Aspects 14-24, further comprising:

(c) liquefying the first hydrocarbon fluid output stream by indirect heat exchange with a second refrigerant after performing step (b).

Aspect 26—The method of an of Aspects 14-24, further comprising:

(c) pre-cooling the hydrocarbon fluid by indirect heat exchange with a second refrigerant before performing step (b).

Aspect 27—The method of Aspect 26, wherein step (b) further comprises liquefying the hydrocarbon fluid and cooling a mixed refrigerant flowing through a coil wound tube side of a main heat exchanger by indirect heat exchange with the mixed refrigerant flowing through a shell side of the main heat exchanger to produce a hydrocarbon fluid product stream.

Aspect 28—A method comprising:

a. cooling a hydrocarbon fluid in a heat exchange system by indirect heat exchange with a first refrigerant stream and warming the first refrigerant stream to produce a warm first refrigerant stream;
b. compressing the warm first refrigerant stream in one or more compression stages and mixing with at least one other refrigerant stream to produce a second refrigerant stream;
c. splitting at least a part of the second refrigerant stream into at least two portions, a first portion and a second portion;
d. compressing the first portion of the second refrigerant stream in a primary compression sequence that includes at least one dynamic compressor to produce a primary compressed stream;
e. compressing the second portion of the second refrigerant stream in a secondary compression sequence, which includes at least one positive displacement compressor, arranged in parallel with the primary compression sequence, to produce a secondary compressed stream;
f. combining the primary compressed stream and the secondary compressed stream to produce a combined compressed refrigerant stream;
g. cooling the combined compressed refrigerant stream to produce a cooled combined refrigerant stream; and
h. expanding the cooled combined refrigerant stream to produce an expanded refrigerant stream.

Aspect 29—The method of Aspect 28, wherein step (a) further comprises at least partially liquefying the hydrocarbon fluid.

DETAILED DESCRIPTION OF INVENTION

Figure 1:
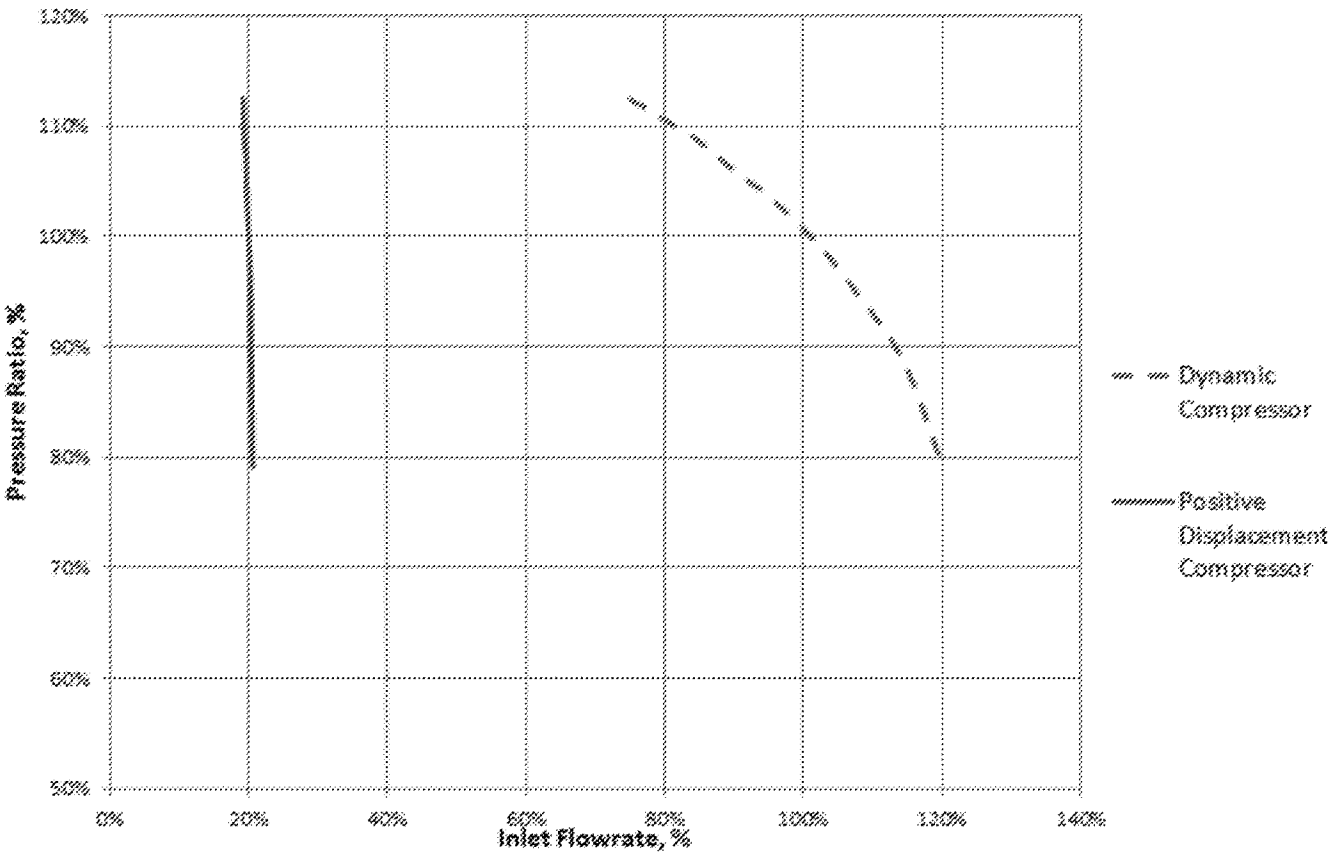
FIG. 1 is a graph showing the percent head versus the percent inlet volumetric flow rate for dynamic and positive displacement compressors.

The ensuing detailed description provides preferred exemplary embodiments only, and is not intended to limit the scope, applicability, or configuration of the claimed invention. Rather, the ensuing detailed description of the preferred exemplary embodiments will provide those skilled in the art with an enabling description for implementing the preferred exemplary embodiments of the claimed invention. Various changes may be made in the function and arrangement of elements without departing from the spirit and scope of the claimed invention.

Reference numerals that are introduced in the specification in association with a drawing figure may be repeated in one or more subsequent figures without additional description in the specification in order to provide context for other features.

In the claims, letters are used to identify claimed steps (e.g. (a), (b), and (c)). These letters are used to aid in referring to the method steps and are not intended to indicate the order in which claimed steps are performed, unless and only to the extent that such order is specifically recited in the claims.

Directional terms may be used in the specification and claims to describe portions of the present invention (e.g., upper, lower, left, right, etc.). These directional terms are merely intended to assist in describing exemplary embodiments, and are not intended to limit the scope of the claimed invention. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

Unless otherwise stated herein, any and all percentages identified in the specification, drawings and claims should be understood to be on a weight percentage basis. Unless otherwise stated herein, any and all pressures identified in the specification, drawings and claims should be understood to mean gauge pressure.

The term "fluid flow communication," as used in the specification and claims, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

The term "natural gas", as used in the specification and claims, means a hydrocarbon gas mixture consisting primarily of methane.

The terms "hydrocarbon gas" or "hydrocarbon fluid", as used in the specification and claims, means a gas/fluid comprising at least one hydrocarbon and for which hydrocarbons comprise at least 80%, and more preferably at least 90% of the overall composition of the gas/fluid.

The term "mixed refrigerant" (abbreviated as "MR"), as used in the specification and claims, means a fluid comprising at least two hydrocarbons and for which hydrocarbons comprise at least 80% of the overall composition of the refrigerant.

The terms "bundle" and "tube bundle" are used interchangeably within this application and are intended to be synonymous.

The term "ambient fluid", as used in the specification and claims, means a fluid that is provided to the system at or near ambient pressure and temperature.

The term "compression circuit" is used herein to refer to the components and conduits in fluid communication with one another and arranged in series (hereinafter "series fluid flow communication"), beginning upstream from the first compressor or compression stage and ending downstream from the last compressor or compressor sage. The term "compression sequence" is intended to refer to the steps performed by the components and conduits that comprise the associated compression circuit.

As used in the specification and claims, the terms "high-high", "high", "medium", and "low" are intended to express relative values for a property of the elements with which the these terms are used. For example, a high-high pressure stream is intended to indicate a stream having a higher pressure than the corresponding high pressure stream or medium pressure stream or low pressure stream described or claimed in this application. Similarly, a high pressure stream is intended to indicate a stream having a higher pressure than the corresponding medium pressure stream or low pressure stream described in the specification or claims, but lower than the corresponding high-high pressure stream described or claimed in this application. Similarly, a medium pressure stream is intended to indicate a stream having a higher pressure than the corresponding low pressure stream described in the specification or claims, but lower than the corresponding high pressure stream described or claimed in this application.

As used herein, the term "cryogen" or "cryogenic fluid" is intended to mean a liquid, gas, or mixed phase fluid having a temperature less than −70 degrees Celsius. Examples of cryogens include liquid nitrogen (LIN), liquefied natural gas (LNG), liquid helium, liquid carbon dioxide and pressurized, mixed phase cryogens (e.g., a mixture of LIN and gaseous nitrogen). As used herein, the term "cryogenic temperature" is intended to mean a temperature below −70 degrees Celsius.

Table 1 defines a list of acronyms employed throughout the specification and drawings as an aid to understanding the described embodiments.

TABLE 1

| | | | |
|---|---|---|---|
| SMR | Single Mixed Refrigerant | MCHE | Main Cryogenic Heat Exchanger |
| DMR | Dual Mixed Refrigerant | MR | Mixed Refrigerant |
| C3MR | Propane-precooled Mixed Refrigerant | MRL | Mixed Refrigerant Liquid |
| LNG | Liquid Natural Gas | MRV | Mixed Refrigerant Vapor |

Figure 2:
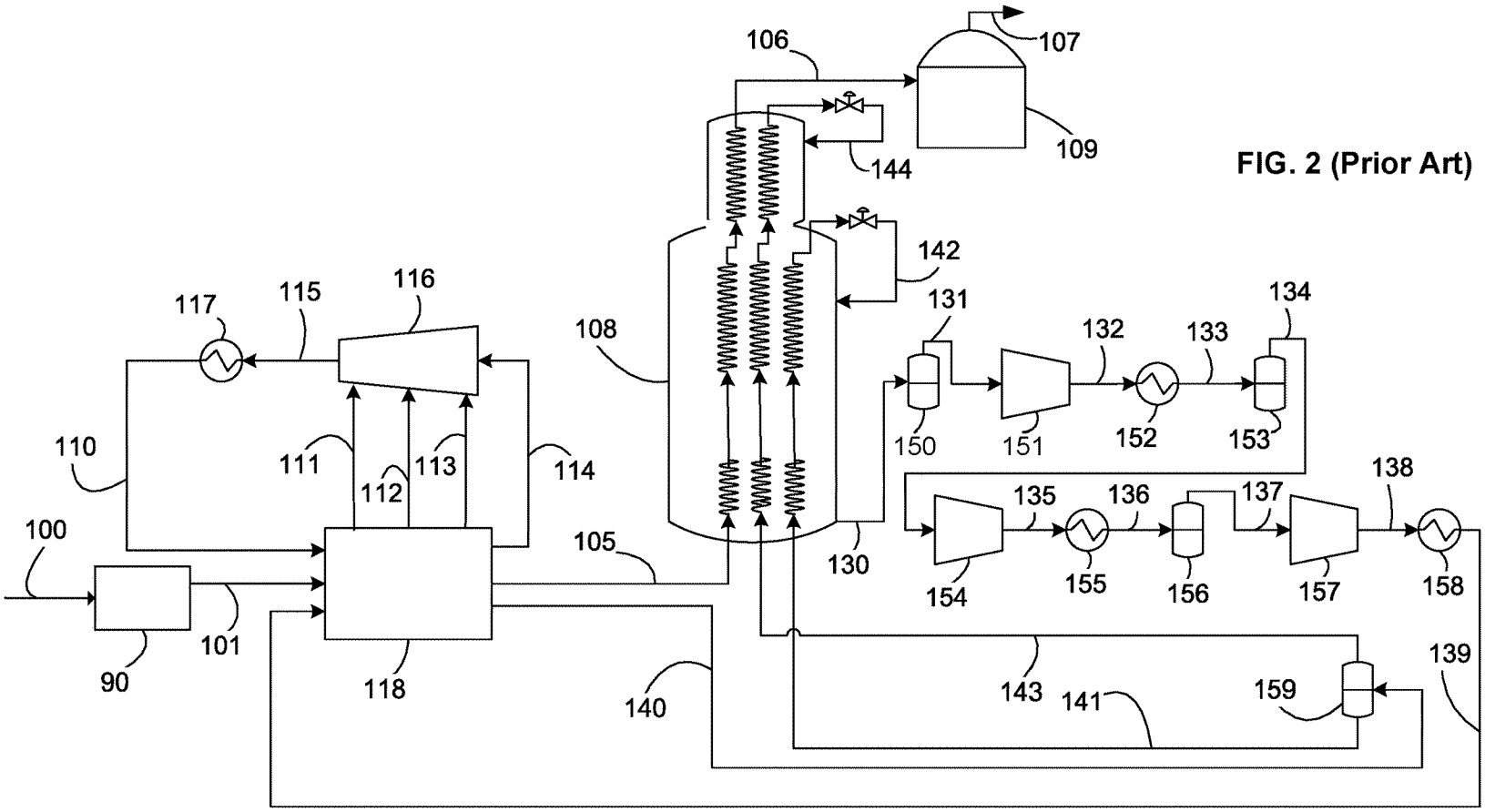
FIG. 2 (Prior Art)
FIG. 2 is a schematic flow diagram of a C3MR system in accordance with the prior art.

The described embodiments provide an efficient process for the liquefaction of a hydrocarbon fluid and are particularly applicable to the liquefaction of natural gas. Referring to FIG. 2, a typical C3MR process of the prior art is shown. A feed stream 100, which is preferably natural gas, is cleaned and dried by known methods in a pre-treatment section 90 to remove water, acid gases such as $CO_2$ and $H_2S$, and other contaminants such as mercury, resulting in a pre-treated feed stream 101. The pre-treated feed stream 101, which is essentially water free, is pre-cooled in a pre-cooling system 118 to produce a pre-cooled natural gas stream 105 and further cooled, liquefied, and/or sub-cooled in an MCHE 108 to produce LNG stream 106. The LNG stream 106 is typically let down in pressure by passing it through a valve or a turbine (not shown) and is then sent to LNG storage tank 109. Any flash vapor produced during the pressure letdown and/or boil-off in the tank is represented by stream 107, which may be used as fuel in the plant, recycled to feed, or vented.

The pre-treated feed stream 101 is pre-cooled to a temperature below 10 degrees Celsius, preferably below about 0 degrees Celsius, and more preferably about −30 degrees Celsius. The pre-cooled natural gas stream 105 is liquefied to a temperature between about −150 degrees Celsius and about −70 degrees Celsius, preferably between about −145 degrees Celsius and about −100 degrees Celsius, and subsequently sub-cooled to a temperature between about −170 degrees Celsius and about −120 degrees Celsius, preferably between about −170 degrees Celsius and about −140 degrees Celsius. MCHE 108 shown in FIG. 2 is a coil wound heat exchanger with three bundles. However, any number of bundles and any exchanger type may be utilized.

The term "essentially water free" means that any residual water in the pre-treated feed stream 101 is present at a sufficiently low concentration to prevent operational issues associated with water freeze-out in the downstream cooling and liquefaction process. In the embodiments described in herein, water concentration is preferably not more than 1.0 ppm and, more preferably between 0.1 ppm and 0.5 ppm.

The pre-cooling refrigerant used in the C3MR process is propane. As illustrated in FIG. 2, propane refrigerant 110 is warmed against the pre-treated feed stream 101 to produce a warm low pressure propane stream 114. The warm low pressure propane stream 114 is compressed in one or more propane compressors 116 that may comprise four compression stages. Three side streams 111, 112, and 113 at intermediate pressure levels enter the propane compressors 116 at the suction of the final, third, and second stages of the propane compressor 116 respectively. The compressed propane stream 115 is condensed in condenser 117 to produce a cold high pressure stream that is then let down in pressure (let down valve not shown) to produce the propane refrigerant 110 that provides the cooling duty required to cool pre-treated feed stream 101 in pre-cooling system 118. The propane liquid evaporates as it warms up to produce warm low pressure propane stream 114. The condenser 117 typically exchanges heat against an ambient fluid such as air or water. Although the figure shows four stages of propane compression, any number of compression stages may be employed. It should be understood that when multiple compression stages are described or claimed, such multiple compression stages could comprise a single multi-stage compressor, multiple compressors, or a combination thereof. The compressors could be in a single casing or multiple casings. The process of compressing the propane refrigerant is generally referred to herein as the propane compression sequence. The propane compression sequence is described in greater detail in FIG. 3.

In the MCHE 108, at least a portion of, and preferably all of, the refrigeration is provided by vaporizing at least a portion of refrigerant streams after pressure reduction across valves or turbines.

A low pressure gaseous MR stream 130 is withdrawn from the bottom of the shell side of the MCHE 108, sent through a low pressure suction drum 150 to separate out any liquids and the vapor stream 131 is compressed in a low pressure (LP) compressor 151 to produce medium pressure MR stream 132. The low pressure gaseous MR stream 130 is typically withdrawn at a temperature at or near propane pre-cooling temperature and preferably about −30 degree Celsius and at a pressure of less than 10 bar (145 psia). The medium pressure MR stream 132 is cooled in a low pressure aftercooler 152 to produce a cooled medium pressure MR stream 133 from which any liquids are drained in medium pressure suction drum 153 to produce medium pressure vapor stream 134 that is further compressed in medium pressure (MP) compressor 154. The resulting high pressure MR stream 135 is cooled in a medium pressure aftercooler 155 to produce a cooled high pressure MR stream 136. The cooled high pressure MR stream 136 is sent to a high pressure suction drum 156 where any liquids are drained. The resulting high pressure vapor stream 137 is further compressed in a high pressure (HP) compressor 157 to produce high-high pressure MR stream 138 that is cooled in high pressure aftercooler 158 to produce a cooled high-high pressure MR stream 139. Cooled high-high pressure MR stream 139 is then cooled against evaporating propane in pre-cooling system 118 to produce a two-phase MR stream 140. Two-phase MR stream 140 is then sent to a vapor-liquid separator 159 from which an MRL stream 141 and a MRV stream 143 are obtained, which are sent back to MCHE 108 to be further cooled. Liquid streams leaving phase separators are referred to in the industry as MRL and vapor streams leaving phase separators are referred to in the industry as MRV, even after they are subsequently liquefied. The process of compressing and cooling the MR after it is withdrawn from the bottom of the MCHE 108, then returned to the tube side of the MCHE 108 as multiple streams, is generally referred to herein as the MR compression sequence.

Both the MRL stream 141 and MRV stream 143 are cooled, in two separate circuits of the MCHE 108. The MRL stream 141 is cooled and partially liquefied in the first two bundles of the MCHE 108, resulting in a cold stream that is let down in pressure to produce a cold two-phase stream 142 that is sent back to the shell-side of MCHE 108 to provide refrigeration required in the first two bundles of the MCHE. The MRV stream 143 is cooled in the first, second, and third second bundles of MCHE 108, reduced in pressure across the cold high pressure letdown valve, and introduced to the MCHE 108 as stream 144 to provide refrigeration in the sub-cooling, liquefaction, and cooling steps. MCHE 108 can be any exchanger suitable for natural gas liquefaction such as a coil wound heat exchanger, plate and fin heat exchanger or a shell and tube heat exchanger. Coil wound heat exchangers are the state of art exchangers for natural gas liquefaction and include at least one tube bundle comprising a plurality of spiral wound tubes for flowing process and warm refrigerant streams and a shell space for flowing a cold refrigerant stream.

Figure 3:
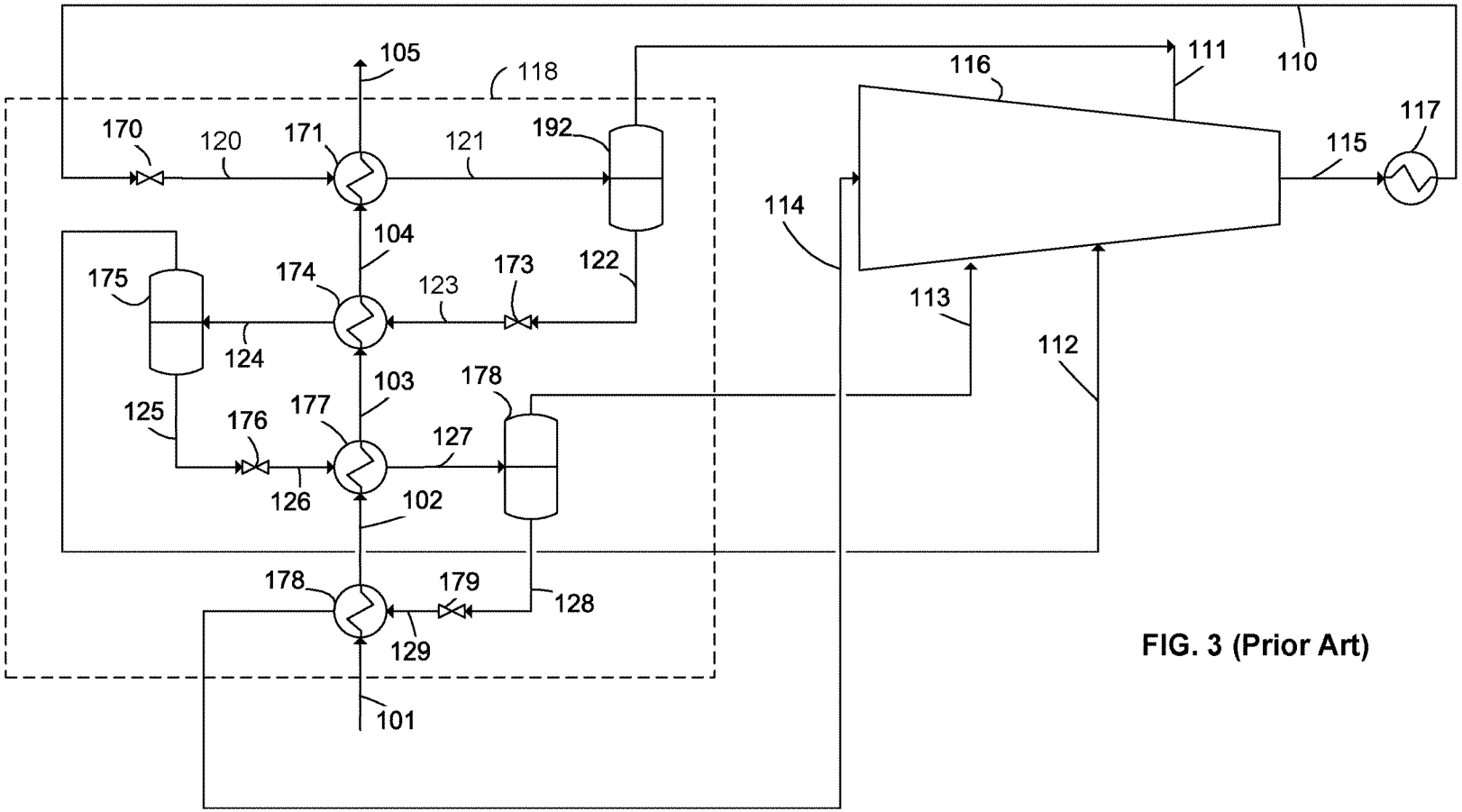
FIG. 3 (Prior Art)
FIG. 3 is a schematic flow diagram of a pre-cooling system of a C3MR system in accordance with the prior art.

FIG. 3 illustrates an exemplary arrangement of the pre-cooling system 118 and the pre-cooling compression sequence depicted in FIG. 1. The pre-treated feed stream 101, as described in FIG. 1, is cooled in evaporators 178, 177, 174, and 171 to produce cooled propane streams 102, 103, 104, and 105 respectively. The warm low pressure propane stream 114 is compressed in propane compressor(s) 116 to produce compressed propane stream 115. The propane compressor 116 is shown as a four stage compressor with side streams 113, 112, and 111 entering it. The compressed propane stream 115 is typically fully condensed in condenser 117 to produce the propane refrigerant 110 that may be let down in pressure in propane expansion valve 170 to produce stream 120, which is partially vaporized in the high-high pressure evaporator 171 to produce a two-phase stream 121, which may then be separated in vapor-liquid separator 192 into a vapor stream and a liquid refrigerant stream 122. The vapor stream is referred to as the high pressure side stream 111 and introduced at the suction of the fourth compression stage of propane compressor 116. The liquid refrigerant stream 122 is let down in pressure in letdown valve 173 to produce stream 123, which is partially vaporized in high pressure evaporator 174 to produce two-phase stream 124, which may then be separated in vapor-liquid separator 175. The vapor portion is referred to as a medium pressure side stream 112 and is introduced at the suction of the third compression stage of the propane compressor 116. The liquid refrigerant stream 125 is let down in pressure in letdown valve 176 to produce stream 126, which is partially vaporized in medium pressure evaporator 177 to produce a two-phase stream 127, which may be phase separated in vapor-liquid separator 192. The vapor portion is referred to as a low pressure side stream 113 and is introduced at the suction of the second compression stage of propane compressor 116. The liquid refrigerant stream 128 is let down in pressure in letdown valve 179 to produce stream 129, which is fully evaporated in low pressure evaporator 178 to produce warm low pressure propane stream 114 that is sent to the suction of the first stage of propane compressor 116.

In this manner, refrigeration may be supplied at four temperature levels corresponding to four evaporator pressure levels. It also possible to have more or less than four evaporators and temperature/pressure levels. Any type of heat exchangers may be used for evaporators 171, 174, 177, and 178 such as kettles, cores, plate and fin, shell and tube, coil wound, core in kettle, etc. In case of kettles, the heat exchanger and vapor-liquid separators may be combined into a common unit.

Propane refrigerant 110 is typically divided into two streams, to be sent to two parallel systems, one to pre-cool the pre-treated feed stream 101 to produce the pre-cooled natural gas stream 105, the other to cool the cooled high-high pressure MR stream 139 to produce two-phase MR stream 140. For simplicity, only the feed pre-cooling circuit is shown in FIG. 2.

Figure 4:
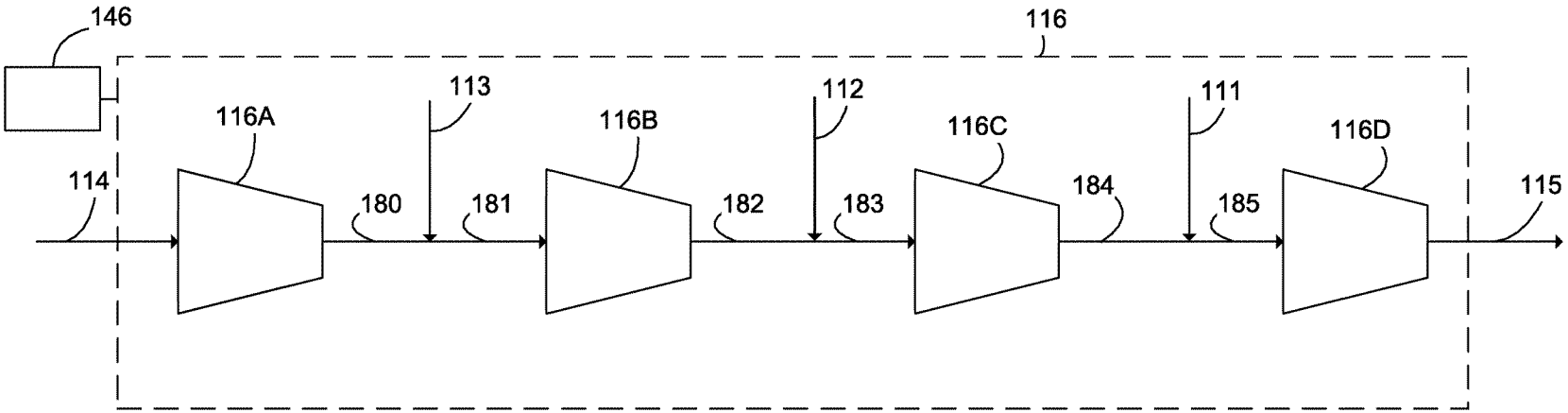
FIG. 4 (Prior Art)
FIG. 4 is a schematic flow diagram of a propane compression system of a C3MR system in accordance with the prior art.

FIG. 4 shows the propane compression system of a C3MR system. Propane compressor 116 may be a single compressor comprising four compression stages or four separate compressors. It could also involve more or less than four compression stages/compressors. A driver 146 (also referred to as a driver assembly) drives the propane compressor 116. Warm low pressure propane stream 114 at a pressure of about 1-5 bara enters the first propane compression stage 116A to produce a medium pressure propane stream 180 at a pressure of about 1.5-10 bara. Medium pressure propane stream 180 then mixes with the low pressure side stream 113 to produce medium pressure mixed stream 181, which is fed to the second propane compression stage 116B to produce a high pressure propane stream 182 at a pressure of about 2-15 bara. High pressure propane stream 182 then combines with the medium pressure side stream 112 to produce high pressure mixed stream 183, which is sent to the third compression stage 116C to produce a high-high pressure propane stream 184 at a pressure of about 2.5-20 bara. High-high pressure propane stream 184 then combines with high pressure side stream 111 to produce high-high pressure mixed stream 185, which is sent to the fourth compression stage 116D to produce compressed propane stream 115 at a pressure of about 2.5 to 30 bara. Compressed propane stream 115 is then condensed in condenser 117 of FIG. 2.

The pre-cooling and liquefaction compressors shown in FIG. 2-4 are typically dynamic or kinetic compressors and specifically centrifugal compressors given their high capacity, variable speed, high efficiency, low maintenance, small size, etc. Other types of dynamic compressors such as axial and mixed flow compressors have also been used for similar reasons. Positive displacement compressors such as reciprocating and screw compressors have typically not been preferred in base-load LNG service because of their lower flow capability that leads to the need for multiple units, higher cost, and larger plot area. FIG. 1 shows the percent pressure ratio versus the percent inlet volumetric flow rate (both values with respect to a fixed reference point) curves for dynamic and positive displacement compressors. As the curves indicate, dynamic compressors often operate at a higher inlet volumetric flow rate as compared to positive displacement compressors. Therefore, they have a higher refrigerant flow capacity that is advantageous in base-load LNG service. Also evident in FIG. 1 is the steep curve for positive displacement compressors as opposed to the more gradual curve for dynamic compressors. A benefit of the gradual curve for centrifugal compressors is that they can be operated at a wide range of flow rates and pressures, which makes them suitable for a variety of operating scenarios. Positive displacement compressors, on the other hand, offer a narrow range of operating flow rates due to the steep curve. Speed variability is another benefit of centrifugal compressors. The pressure and volumetric flow rates can be adjusted by varying speed to optimize plant performance. There is an impact of speed variation in positive displacement compressors also, but often the speed range is smaller. While these aspects of positive displacement compressors are typically considered drawbacks for use in base-load LNG compression service, the invention described here provides novel methodologies for utilizing positive displacement compressors to debottleneck LNG plants.

There are two primary compression circuits in the embodiment shown in FIGS. 2 through 4. The first primary compression circuit is part of the C3MR process, begins at the warm low pressure propane stream 114, ends at the compressed propane stream 115, and includes the four compression stages 116A, 116B, 116C, 116D. The second primary compression circuit is part of the MR compression system, begins at the vapor stream 131, ends at the high-high pressure MR stream 138, and includes the LP compressor 151, the low pressure aftercooler 152, the medium pressure suction drum 153, the MP compressor 154, the medium pressure aftercooler 155, the high pressure suction drum 156, and the HP compressor 157.

Figure 5:
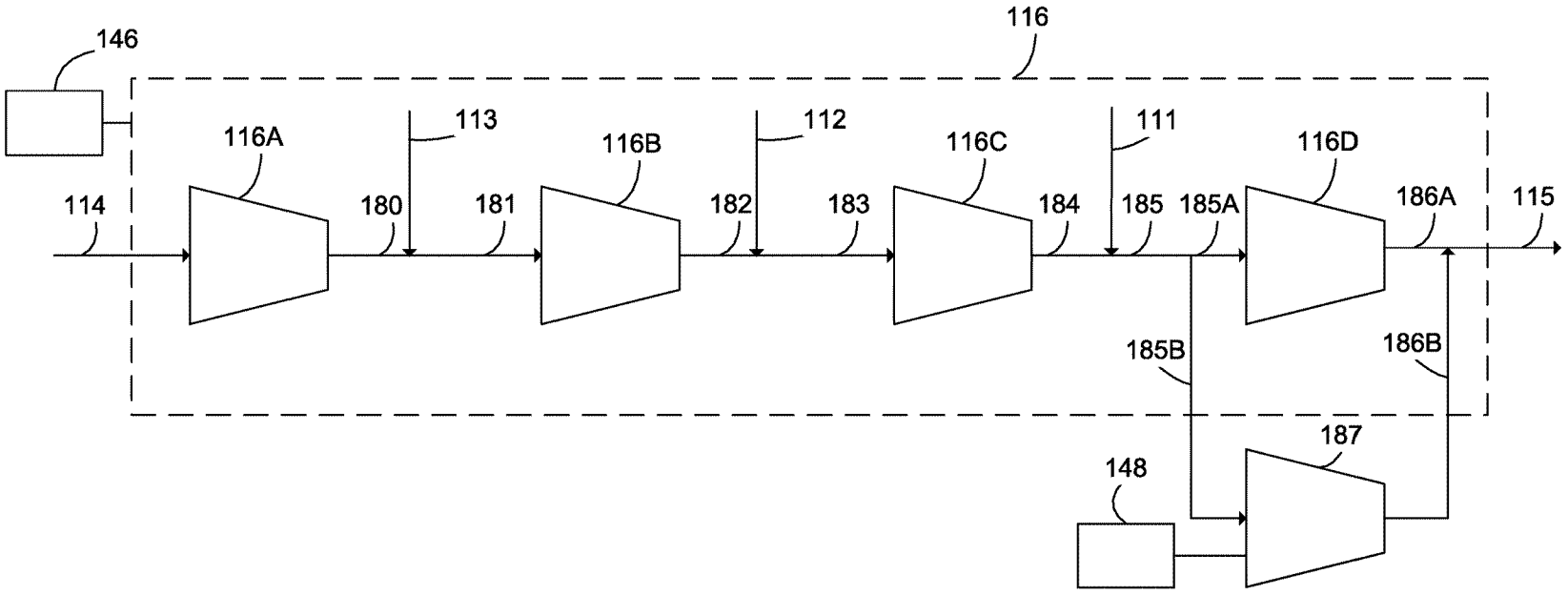
FIG. 5 is a schematic flow diagram of a propane compression system of a C3MR system in accordance with a first exemplary embodiment of the invention.

FIG. 5 represents an exemplary embodiment of the invention wherein plant performance is limited by the propane compressor and specifically the fourth compression stage 116D of the propane compressor 116. Except as described herein, the embodiment shown in FIG. 5 is identical to the embodiment described above and with reference to FIGS. 2 through 4. FIG. 5 shows a propane compression sequence wherein the propane compressor 116 includes four compression stages shown as 116A, 116B, 116C, and 116D. There are various scenarios where fourth compression stage 116D may be the bottleneck. For example, the fourth compression stage 116D could be at the maximum flow capacity limitation (nearing the stonewall condition) or it could be at the maximum head constraint (nearing the surge condition). These scenarios are driven by plant operating conditions such as production rate, ambient temperature, feed gas pressure, etc. The fourth compression stage 116D could also be at any other compressor design specification or operation limitation.

In order to debottleneck the fourth compression stage 116D, a positive displacement compressor 187 is provided in parallel to the fourth compression stage 116D. The high-high pressure mixed stream 185 splits into two: a primary compressor stream 185A and a secondary compressor stream 185B. Preferably more than 50% of the high-high pressure mixed stream 185 directed to the primary compressor stream 185A. More preferably, more than 70% of the high-high pressure mixed stream 185 directed to the primary compressor stream 185A. A proportional valve (not shown) or other suitable control device could be optionally provided to enable adjustment of the flow split between the primary compressor stream 185A and a secondary compressor stream 185B. In this embodiment, the propane compressor 116 is a dynamic or kinetic compressor, such as a centrifugal compressor, and the positive displacement compressor 187 is a screw compressor or a reciprocating compressor. In alternate embodiments, the positive displacement compressor 187 could consist of multiple stages and/or multiple compressors.

The outlet streams 186A and 186B from both compressors 116, 187 are combined to produce a compressed propane stream 115, which is sent to the condenser 117 of FIG. 2. Multiple condensers (not shown) may also be employed if desired. The positive displacement compressor 187 may be driven by any excess driver power available in the LNG plant or by a dedicated electric motor 148 (as shown in FIG. 2) or any other source of power.

The term "secondary" is used herein to identify fluid streams, compression circuits, compression sequences, and compressors that are arranged in parallel with at least a portion of a "primary" streams, compression circuits, compression sequences, and compressors. The term "secondary" is also used because the parallel use of a positive displacement compressor may be implemented as a retrofit to one or more dynamic compressors in existing LNG plants. Except as specifically stated herein, the terms "secondary" and "primary" are not intended to imply relative capacity or performance characteristics. In this embodiment, the secondary compression circuit consists of the secondary compressor stream 185B, the positive displacement compressor 187, and the outlet stream 186B.

The pressure of the compressed propane stream 115 determines the condensing temperature in the condenser 117, which, in turn, determines the pre-cooling temperature and impacts the overall efficiency of the LNG plant. To improve performance of embodiment of FIG. 5, it is desirable to match the outlet pressure of the fourth compression stage 116D and the positive displacement compressor 187. Given the steep head versus flow rate curve of positive displacement compressors (see FIG. 1), pressure matching is automatically achieved by the characteristics of positive displacement compressor 187 without having to account for the impact of volumetric flow rate. The flow split between the primary and secondary compressor streams 185A, 185B can therefore be adjusted to achieve the desired total refrigerant flow rate and plant performance. It may be desirable to adjust the flow split during plant operation as the driving force for changes in operation of the positive displacement compressor 187. Further process adjustments can be made by varying the speed of the compressors in the primary compression circuit or the compressors in the secondary compression circuit independently.

Figure 6:
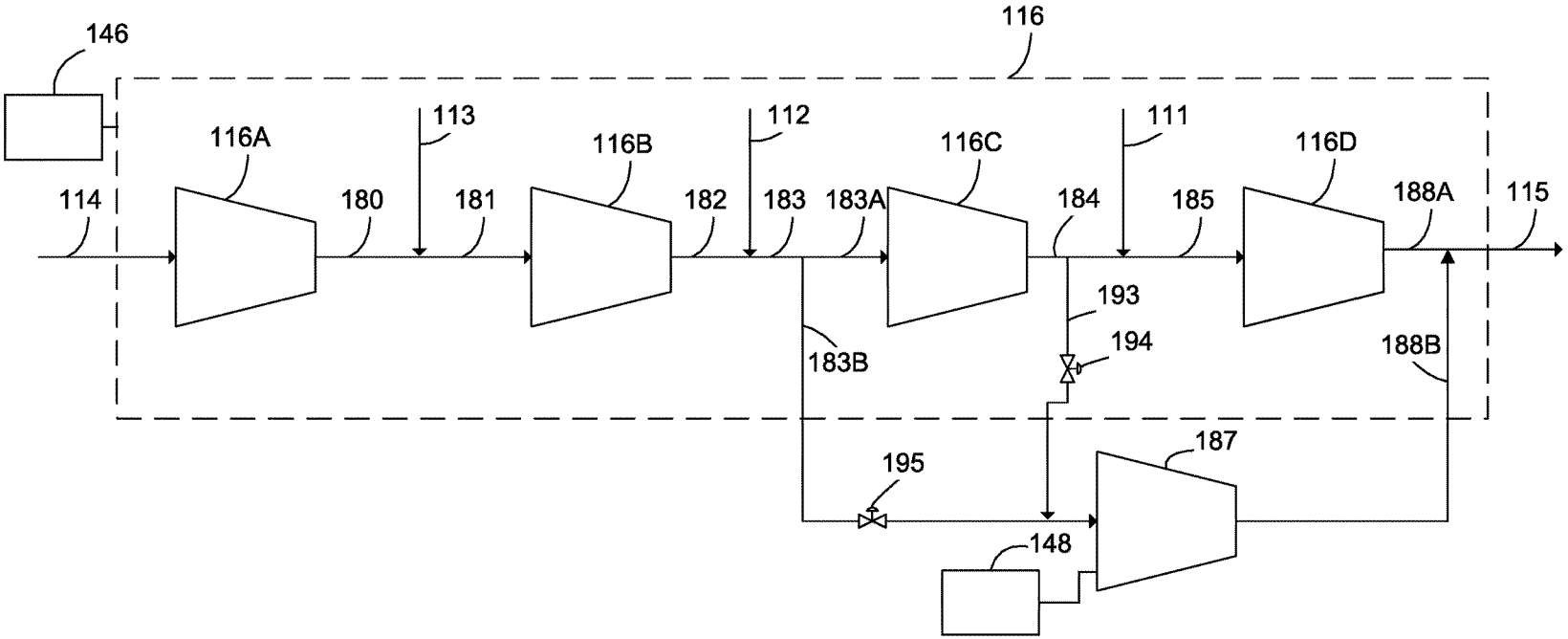
FIG. 6 is a schematic flow diagram of a propane compression system of a C3MR system in accordance with a second exemplary embodiment of the invention.

FIG. 6 shows a variant of FIG. 5 wherein a secondary compression circuit is installed in parallel with the third and fourth compression stages 116C, 116D of the propane compressor 116. Except as otherwise stated, the embodiment of FIG. 6 is identical to the embodiment described above with respect to FIG. 5. In this embodiment, the high pressure mixed stream 183 is split into the primary compressor stream 183A and the secondary compressor stream 183B. The primary compressor stream 183A is sent to the third compression stage 116C of the primary compression circuit, followed by mixing with high pressure side stream 111 and compression in the fourth compression stage 116D of the primary compression circuit while the secondary compressor stream 183B is sent to the positive displacement compressor 187 of the secondary compression circuit. The outlet streams 188A and 188B mix to produce compressed propane stream 115, which is sent to the condenser 117 of FIG. 2. In this embodiment, the secondary compression circuit consists of the secondary compressor stream 185B, the positive displacement compressor 187, and the outlet stream 188B.

The arrangement of this embodiment is advantageous when both the third and fourth compression stages 116C, 116D of the compressor 116 are limiting LNG production. The primary compression circuit includes at least one dynamic compressor, such as a centrifugal compressor, while the secondary compression circuit includes at least one positive displacement compressor, such as a screw compressor. In alternate embodiments, the secondary compression circuit may be provided in parallel with any number of compression stages. In most applications it will be preferable to have the secondary compression circuit arranged in parallel with the compressors or compression stages of the primary compression circuit that operate at a higher pressure than any of the compressors or compression stages that are not arranged in parallel with the secondary compression circuit.

As a further variation of FIG. 6, the secondary compression circuit could be provided with valves 194, 195 and a conduit 193 that would allow the positive displacement compressor 187 to be operated in parallel to only the fourth compression stage 116D under certain operating conditions and be operated in parallel to both the third and fourth compression stages 116C,116D under other operating conditions. A benefit of this embodiment of the invention over prior art, in addition to the many benefits listed for the embodiment shown in FIG. 5, is that it allows for flexible operation of the compression system while debottlenecking compressor performance.

Although FIGS. 5-6 and the associated description refer to the propane pre-cooling compressor of a C3MR liquefaction cycle, the invention is applicable to any other refrigerant type including, but not limited to, two-phase refrigerants, gas-phase refrigerants, mixed refrigerants, pure component refrigerants (such as nitrogen) etc. In addition, it is potentially useful in a refrigerant being used for any service utilized in an LNG plant, including pre-cooling, liquefaction or sub-cooling. The invention may be applied to a compression system in a natural gas liquefaction plant utilizing any process cycle including SMR, DMR, nitrogen expander cycle, methane expander cycle, AP-X, cascade and any other suitable liquefaction cycle. Additionally, the invention may be applied to both open-loop and closed-loop liquefaction cycles.

Figure 7:
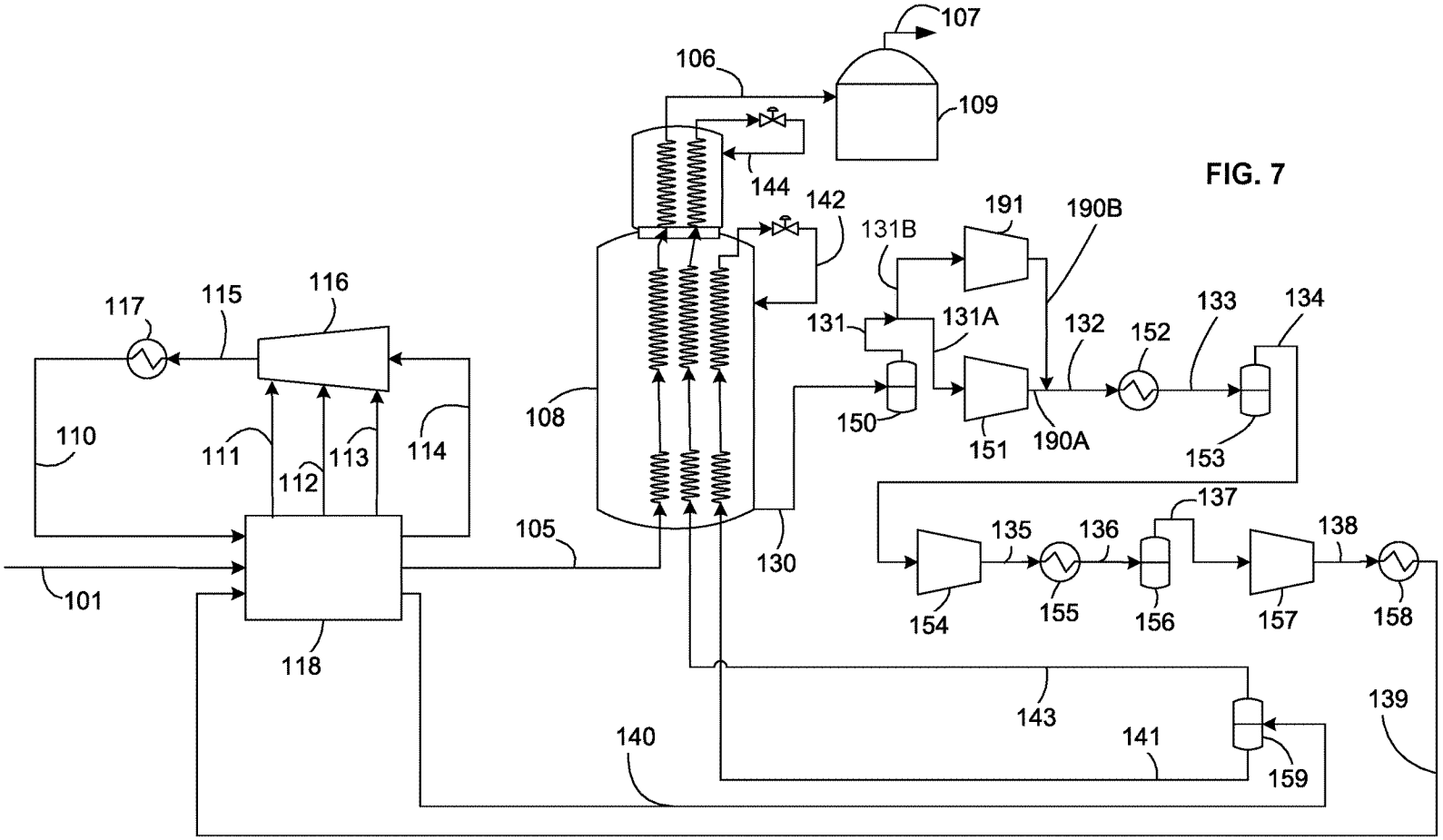
FIG. 7 is a schematic flow diagram of a mixed refrigerant compression system of a C3MR system in accordance with a third exemplary embodiment of the invention.

FIG. 7 represents a further embodiment of the invention wherein the low pressure MR (LP MR) compressor 151 is limiting plant performance. Except as otherwise stated below, the embodiment of FIG. 7 is identical to the embodiment described above with reference to FIGS. 2 through 4. In addition, the embodiment of FIG. 7 could be implemented in combination with the embodiment of FIG. 5.

In this embodiment, the MR refrigerant vapor stream 131 is split into two streams: a primary compressor stream 131A and a secondary compressor stream 131B. The primary compressor stream 131A is sent to the primary LP MR compressor 151 (part of the primary compression circuit) to produce outlet stream 190A. The secondary compressor stream 131B is sent to a secondary compressor 191 (part of the secondary compression circuit) to produce outlet stream 190B. Outlet streams 190A and 190B are combined to produce medium pressure MR stream 132, which is sent to the low pressure aftercooler 152 to produce cooled medium pressure MR stream 133. Separate aftercoolers (not shown) may also be employed if desired. The primary compression circuit includes at least one dynamic compressor, such as a centrifugal compressor, while the secondary compression circuit includes at least one positive displacement compressor, such as a screw compressor. In this embodiment, the secondary compression circuit begins at the secondary compressor stream 131B, includes the secondary compressor 191, and ends at the outlet stream 109B.

The benefits of this embodiment over prior art, in addition to all the benefits listed for previous embodiments, is that of MR composition flexibility. In a mixed refrigerant liquefaction process, the composition of the MR stream is typically varied during plant operation based on feed composition changes, ambient temperature changes, feed pressure changes, LNG production rate changes and so on in order to achieve desired heat exchanger cooling curves and overall process efficiency. Unlike dynamic compressors, positive displacement compressors are fairly insensitive to MR composition changes and therefore the split between the primary compression circuit and the secondary compression circuit can be adjusted as needed with MR composition changes without impacting the head.

In alternate embodiments, it would be possible to install the secondary compression circuit in parallel with any or all of the stage or compressors in the MR compression circuit. The secondary compression circuit can be added in parallel to the entire MR compression system or just the stages or compressors that are limiting. The secondary compressor 191 may be driven by any excess driver power available in the LNG plant or by a separate electric motor or any other source of power. In addition, in some embodiments, a portion of the refrigerant may be removed before splitting the refrigerant between the primary and secondary compression circuits.

Another exemplary embodiment of the invention is applicable to scenarios wherein the LNG production is limited by the available driver power, such as at high production rates or during high ambient temperature due to reduced available power for gas turbine drivers. In such cases, an additional driver may be provided to drive secondary compressors. This would increase the available power in the compression systems and, at the same time, provide a convenient way to distribute the additional power to the compression systems and debottleneck the limiting stages. This is especially beneficial when performing a retrofit design to increase the capacity of an existing LNG plant.

The embodiments of the invention described herein are applicable to any compressor design including any number of compressors, compressor casings, compression stages, presence of inter or after-cooling, etc. Additionally, the secondary compression circuit may comprise multiple compressors or compression stages in series or in parallel. The invention is applicable to various types of positive displacement compressors such as reciprocating or piston-type compressors as well as rotary vane or screw compressors. The methods and systems associated with this invention can be implemented as part of new plant design or as a retrofit to debottleneck existing LNG plants.

Example 1

The following is an example of the operation of an exemplary embodiment of the invention. The example process and data are based on simulations of a C3MR process similar to FIGS. 2 through 4 in a plant that produces about 4 million metric tons per annum of LNG and specifically refers to the embodiment shown in FIG. 5. In order to simplify the description of this example, elements and reference numerals described with respect to the embodiment shown in FIG. 5 will be used.

In this example, the plant performance is limited by the fourth compression stage 116D of the propane compressor 116, which is a centrifugal compressor operating at the maximum head possible and is at the anti-surge line due to high ambient operating conditions. A screw compressor is added a parallel with the fourth compression stage 116D. Warm low pressure propane stream 114 enters the first propane compression stage 116A at 1.2 bara (17.4 psia), −36 degrees C. (−33 degrees F.) and a refrigerant flow rate of 102,826 $m^3$/hr (3,631,266 $ft^3$/hr), and exits at a pressure of 2.3 bara (33.4 psia), −10 degrees C. (14 degrees F.). It mixes with a low pressure side stream 113 at the same pressure and flow rate of 73,644 $m^3$/hr (2,600,713 $ft^3$/hr). The medium pressure mixed stream 181 enters the second propane compression stage 116B and is compressed to 4.2 bara (60.9 psia) and 9 degrees C. (48 degrees F.), which mixes with a medium pressure side stream 112 at the same pressure and flow rate of 62,780 $m^3$/hr (2,217,055 $ft^3$/hr). The high pressure mixed stream 183 enters the third compression stage 116C and is compressed to 7.5 bara (108.8 psia) and 29 degrees C. (84 degrees F.), which mixes with a high pressure side stream 111 at the same pressure and flow rate of 84,305 m3/hr (2,977,203 $ft^3$/hr). The high-high pressure mixed stream 185 is split into the primary compressor stream 185A and the secondary compressor stream 185B. The flow rate of the secondary compressor stream 185B is 17,160 $m^3$/hr (606,000 $ft^3$/hr). Both streams are compressed to 22.8 bara (330.7 psia) to produce outlet streams 186A and 186B, which are combined to produce compressed propane stream 115 at 22.8 bara (330.7 psia) and flow rate of 166,694 $m^{31}$ hr (5,886,743 $ft^3$/hr).

The liquefaction system power requirement increased by 1.4% to account for additional power required to drive the screw compressor. In this case, this quantity of additional power was available in the LNG plant and was utilized to drive the secondary compressor. The overall LNG production of the plant increased by 3.9%. Therefore, the invention was successful in debottlenecking the propane compressor and resulted in improved plant capacity and efficiency.

Example 2

The following is an example of the operation of an exemplary embodiment of the invention. The example process and data are based on simulations of a C3MR process similar to FIGS. 2 through 4 in a plant that produces about 4 million metric tons per annum of LNG and specifically refers to the embodiment shown in FIG. 6. In order to simplify the description of this example, elements and reference numerals described with respect to the embodiment shown in FIG. 6 will be used.

This example is a similar operating scenario as EXAMPLE 1, the only difference being that both the third and fourth compression stages 116C and 116D of the propane compressor are bypassed using positive displacement compressor 187, which is a screw compressor in this example. Warm low pressure propane stream 114 enters the first propane compression stage 116A at 1.3 bara (18.9 psia), −35 degrees C. (−31 degrees F.) and flow rate of 108,070 m3/hr (3,816,450 $ft^3$/hr) and exits at a pressure of 2.3 bara (33.4 psia), −10 degrees C. (14 degrees F.). It mixes with a low pressure side stream 113 at the same pressure and flow rate of 77,133 $m^3$/hr (2,723,926 $ft^3$/hr). The medium pressure mixed stream 181 enters the second propane compression stage 116B and is compressed to 4.2 bara (60.9 psia) and 9 degrees C. (48 degrees F.) and mixed with the medium pressure side stream 112 at the same pressure and flow rate of 65,111 $m^3$/hr (2,299,373 $ft^3$/hr). The high pressure mixed stream 183 is split into the primary compressor stream 183A and the secondary compressor stream 183B. The flow rate of 183B is 9,677 $m^3$/hr (341,740 $ft^3$/hr). The secondary compressor stream 183B is compressed in a positive displacement compressor 187 (which is a reciprocating compressor in this example) 189 to 22.8 bara (330.7 psia). Primary compressor stream 183A is compressed in the third compression stage 116C to 7.5 bara (108.8 psia) and 29 degrees C. (84 degrees F.) and mixed with a high pressure side stream 111 at the same pressure and flow rate of 68,011 $m^3$/hr (2,401,786 $ft^3$/hr). The high-high pressure mixed stream 185 enters the fourth compression stage 116D and is compressed to 22.8 bara (330.7 psia). Outlet streams 188A and 188B are combined to produce compressed propane stream 115 at 22.8 bara (330.7 psia) and flow rate of 159,207 $m^3$/hr (5,622,342 $ft^3$/hr).

In this case, the liquefaction system power requirement increased by 3% in order to drive the secondary compressor (positive displacement compressor). This quantity of additional power was available in the LNG plant and was utilized to drive the secondary compressor. The overall LNG production of the plant increased by 2%. Therefore, the invention was successful in debottlenecking the propane compressor and lead to improved plant capacity during high ambient conditions.

An invention has been disclosed in terms of preferred embodiments and alternate embodiments thereof. Of course, various changes, modifications, and alterations from the teachings of the present invention may be contemplated by those skilled in the art without departing from the intended spirit and scope thereof. It is intended that the present invention only be limited by the terms of the appended claims.

What is claimed is:

1. An apparatus for liquefying a hydrocarbon fluid comprising:

a compression system operationally configured to compress a first refrigerant to produce a first compressed refrigerant stream, the compression system comprising a primary compression circuit having a plurality of compression stages, each comprising a dynamic compressor and a secondary compression circuit having at least one compression stage comprising a positive displacement compressor, the secondary compression circuit being in fluid flow communication with the primary compression circuit and arranged parallel to a first portion of the primary compression circuit, the compression system further comprising a driver assembly operationally configured to provide power to the at least one compression stage of the primary compression circuit and the at least one compression stage of the secondary compression circuit;

a first heat exchanger operationally configured to cool the hydrocarbon fluid by indirect heat exchange between at least a portion of the first refrigerant and the hydrocarbon fluid;

wherein the primary compression circuit further comprises a second portion and the compression system is operationally configured to compress all of the first refrigerant in the second portion of the primary compression circuit.

2. The apparatus of claim 1, wherein the compression system is further operationally configured to inter-cool the first refrigerant between at least two of the plurality of compression stages of the primary compression circuit.

3. The apparatus of claim 1, wherein the primary compression circuit comprises the plurality of compression stages and the primary compression circuit comprises the second portion, at least one of the plurality of compression stages being located in the first portion and at least one of the plurality of compression stages being located in the second portion, the secondary compression circuit being arranged in parallel with only the first portion of the primary compression circuit, each of the at least one of the plurality of compression stages located in the first portion being operationally configured to operate at a higher pressure than all of the at least one of the plurality of compression stages located in the second portion.

4. The apparatus of claim 1, further comprising a second heat exchanger operationally configured to further cool and liquefy the hydrocarbon fluid by indirect heat exchange between the hydrocarbon fluid and a second refrigerant after the hydrocarbon fluid has been cooled by the first heat exchanger.

5. The apparatus of claim 1, wherein the first refrigerant is propane, a mixed refrigerant, or nitrogen.

6. The apparatus of claim 4, wherein the second heat exchanger is operationally configured to liquefy the hydrocarbon fluid and cool the second refrigerant as the hydrocarbon fluid and the second refrigerant flow through a coil wound tube side of the second heat exchanger by indirect heat exchange with the second refrigerant flowing through a shell side of the second heat exchanger.

7. The apparatus of claim 1, further comprising a second heat exchanger operationally configured to pre-cool the hydrocarbon fluid by indirect heat exchange between the hydrocarbon fluid and a second refrigerant before the hydrocarbon fluid is further cooled by the first heat exchanger.

8. The apparatus of claim 7, wherein the second refrigerant is propane and the first refrigerant is a mixed refrigerant.

9. The apparatus of claim 7, wherein the first heat exchanger is operationally configured to liquefy the hydrocarbon fluid and cool the first refrigerant as the hydrocarbon fluid and the first refrigerant flow through a coil wound tube side of the first heat exchanger by indirect heat exchange with the first refrigerant flowing through a shell side of the first heat exchanger.

10. The apparatus of claim 1, wherein the driver assembly including a first driver for the primary compression circuit and a second driver for the secondary compression circuit, the first driver being independent of the second driver.

11. The apparatus of claim 1, further comprising a valve operationally configured to control a distribution of flow of the first refrigerant between primary compression circuit and the secondary compression circuit.

12. The apparatus of claim 1, wherein the dynamic compressor is a centrifugal compressor and the positive displacement compressor is a screw compressor.

13. A method comprising:

a. performing a compression sequence on a first refrigerant stream, the compression sequence comprising compressing the first refrigerant stream to produce a compressed first refrigerant stream; and b. cooling a hydrocarbon fluid by indirect heat exchange against the compressed first refrigerant stream to produce a first hydrocarbon fluid output stream and a warmed first refrigerant stream;

wherein step (a) further comprises splitting the first refrigerant stream into a first portion and a second portion, the first portion comprising at least 70% and less than 100% of the first refrigerant stream, compressing all of the first portion of the first refrigerant stream in a primary compression sequence including at least one dynamic compressor and comprising a plurality of compression stages to produce a primary compressed stream, compressing the first refrigerant stream in at least one of the plurality of compression stages of the primary compression sequence before splitting the first refrigerant stream into the first portion and the second portion, compressing the second portion of the first refrigerant stream in a secondary compression sequence including at least one positive displacement compressor to produce a secondary compressed stream, and combining the primary compressed stream and the secondary compressed stream to produce a combined compressed refrigerant stream.

14. The method of claim 13, wherein step (a) further comprises cooling the first refrigerant stream between two of the plurality of compression stages.

15. The method of claim 13, wherein step (a) further comprises removing a third portion of the first refrigerant from the first refrigerant stream before splitting the first refrigerant stream into the first portion and the second portion.

16. The method of claim 13, wherein step (a) further comprises combining at least one first refrigerant side stream with the first refrigerant stream.

17. The method of claim 16, wherein step (a) further comprises combining at least one of the at least one first refrigerant side stream with the first refrigerant stream before splitting the first refrigerant stream into the first portion and the second portion.

18. The method of claim 13, wherein step (a) further comprises cooling the combined compressed refrigerant stream in at least one heat exchanger prior to producing the compressed first refrigerant stream.

19. The method of claim 13, wherein step (a) further comprises further compressing the combined compressed refrigerant stream prior to producing the compressed first refrigerant stream.

20. The method of claim 13, wherein the compressed first refrigerant stream is cooled and expanded prior to the indirect heat exchange in step (b).

21. The method of claim 13, further comprising:

(c) liquefying the first hydrocarbon fluid output stream by indirect heat exchange with a second refrigerant after performing step (b).

22. The method of claim 13, further comprising:

(c) pre-cooling the hydrocarbon fluid by indirect heat exchange with a second refrigerant before performing step (b).

23. The method of claim 22, wherein step (b) further comprises liquefying the hydrocarbon fluid and cooling a mixed refrigerant flowing through a coil wound tube side of a main heat exchanger by indirect heat exchange with the mixed refrigerant flowing through a shell side of the main heat exchanger to produce a hydrocarbon fluid product stream.

24. The method of claim 13, further comprising:

(c) driving the plurality of compression stages of the primary compression sequence with a driver; and (d) driving the positive displacement compressor of the secondary compression sequence with an electric motor.

25. The method of claim 13, wherein step (a) further comprises:

(a) performing the compression sequence on the first refrigerant stream at the first refrigerant stream flow rate, the compression sequence comprising compressing the first refrigerant stream to produce the compressed first refrigerant stream;

wherein performing step (a) at the first refrigerant stream flow rate would cause at least one of the plurality of compression stages of the primary compression sequence to exceed at least one selected from the group of: the maximum flow capacity and maximum head constraint if 100% of the first refrigerant stream was directed through the at least one of the plurality of compression stages of the primary compression sequence.

26. A method of operating a baseload LNG plant, the method comprising:

(a) pre-cooling a hydrocarbon stream against a first refrigerant to create a cooled hydrocarbon stream and a warmed first refrigerant stream;

(b) further cooling the cooled hydrocarbon stream against a second refrigerant to produce an at least partially liquefied hydrocarbon stream and a warmed second refrigerant stream;

(c) performing a compression sequence on the warmed first refrigerant stream, the compression sequence comprising compressing the warmed first refrigerant stream to produce a compressed first refrigerant stream; the compression sequence comprising:

(i) compressing all of the warmed first refrigerant stream in at least a first compression stage of a primary compression sequence to produce a partially compressed first refrigerant stream, the primary compression sequence comprising a plurality of primary compression stages, each of the primary compression stages being a dynamic compressor;

(ii) splitting the partially compressed first refrigerant stream into a first portion and a second portion;

(iii) further compressing the first portion in the remaining compression stages of the plurality of primary compression stages to produce a first portion of a compressed first refrigerant stream at a first compressed pressure;

(iv) further compressing the second portion in a secondary compression sequence comprising at least one positive displacement compressor to produce a second portion of a compressed first refrigerant stream at a second compressed pressure; and (v) combining the first portion and second portion of the compressed first refrigerant stream.

27. The method of claim 26, wherein step (a) further comprises pre-cooling the hydrocarbon stream against the first refrigerant to create the cooled hydrocarbon stream and the warmed first refrigerant stream, wherein the first refrigerant is propane.

28. The method of claim 26, wherein step (b) further comprises further cooling the cooled hydrocarbon stream against the second refrigerant to produce the at least partially liquefied hydrocarbon stream and the warmed second refrigerant stream, wherein the second refrigerant is a mixed refrigerant.

* * * * *